United States Patent [19]

Young

[11] 4,028,757

[45] June 14, 1977

[54] RAKER CLAW HAMMER

[76] Inventor: Clifford Kenneth Young, P.O. Box 787, Kings Beach, Calif. 95719

[22] Filed: May 19, 1975

[21] Appl. No.: 578,506

[52] U.S. Cl. ..... 7/8.1 R; 254/26 R

[51] Int. Cl.[2] ..... B25F 1/00

[58] Field of Search ..... 7/8.1 R; 145/2 R, 21; 254/26 R

[56] References Cited

UNITED STATES PATENTS

| | | | |
|---|---|---|---|
| 89,013 | 4/1869 | Blake | 7/8.1 R |
| 513,463 | 1/1894 | Ketchum | 254/26 R |
| 3,760,656 | 9/1973 | Veach | 254/26 R |

*Primary Examiner*—Al Lawrence Smith
*Assistant Examiner*—Roscoe V. Parker

[57] ABSTRACT

An improved raker claw hammer, composed of a handle, a hammerhead, and a claw, the plane of the claw being parallel to the axis of the handle, for extracting nails by inertia or by leverage. The claw, which is composed of two prongs in V-shaped configuration, has one of its prongs sharpened for cutting, chipping, or dragging wood. In the area between the prongs is a V-shaped groove for gripping nail heads for each extraction.

1 Claim, 5 Drawing Figures

FIG_1
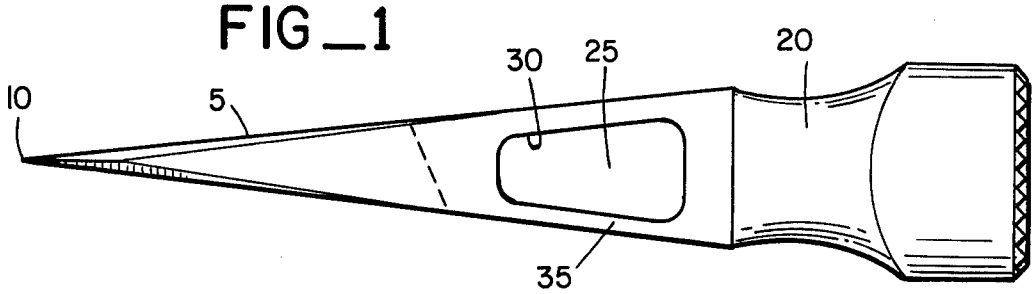
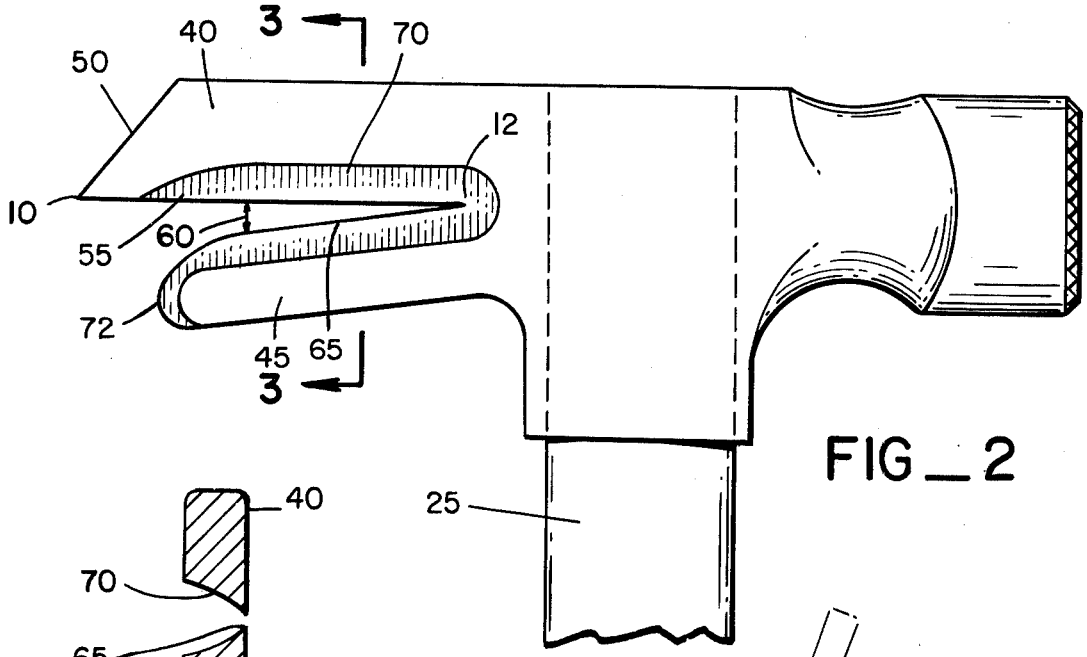
FIG_2
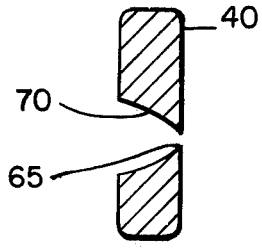
FIG_3
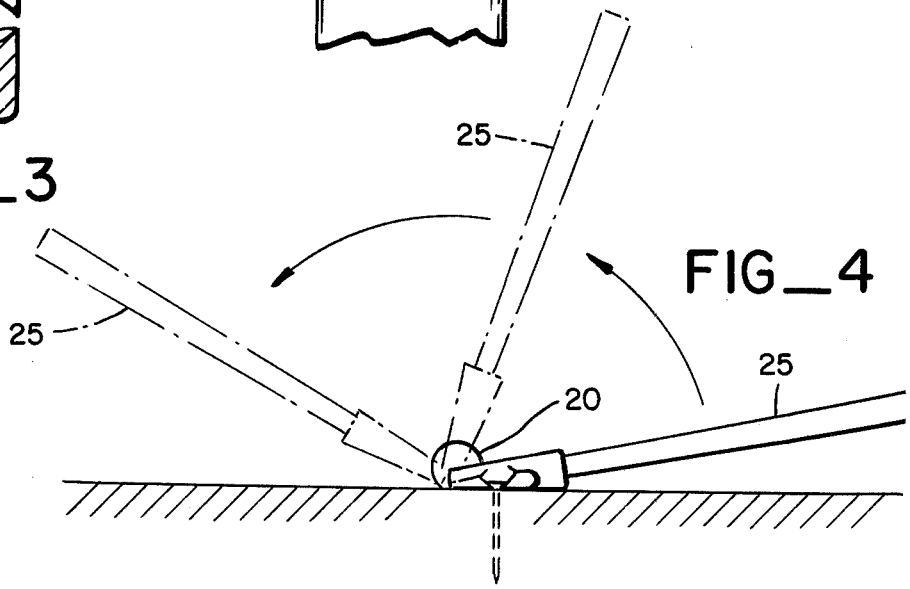
FIG_4
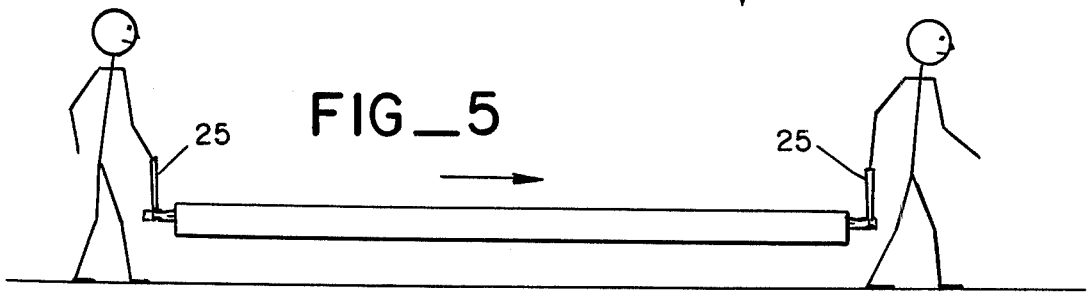
FIG_5

RAKER CLAW HAMMER

SUMMARY OF THE PRIOR ART

Conventional claw hammers are typically composed of a handle, a hammerhead, and a claw, the plane of the claw being curved and at right angles to the axis of the hammer handle. Typically, such claws are constructed without peripheral sharp edges for chipping or cutting. Moreover, such claws are constructed so that nails may only be extracted by leverage. That is to say, the curved claw, which has a V-shaped groove for receiving at its wide end the shank of a nail and retaining at its narrow end the nail head, must first be positioned under the nail head so that the hammerhead rests securely on the surface of the wood from which the nail is to be withdrawn. Then the handle is manipulated so that a fulcrum-lever effect lifts the nail out of the wood. Unfortunately, because the hammer handle is at right angles to the plane of the wood from which the nail is withdrawn, the hammer can at most have 90 degrees of rotation in lifting the nail out of the wood. Moreover, conventional hammers are not equipped with a sharp edge for chipping away portions of wood, but are simply designed for hammering nails and extracting them. Thus, two different tools have to be used for hammering and clipping.

Further, conventional hammers are ill qualified for dragging plywood or planks horizontally or transporting beams horizontally as in FIG. 5 by embedding the end of the claw into such plywood or planks or beams.

Finally, the plane of the extreme tips of the claws of conventional hammers being perpendicular to the axis of the hammer handle, have a relatively thick profile which encumbers nailing in a limited or restricted space such as is typically present during joicing operations.

OBJECTS OF THE PRESENT INVENTION

Therefore, it is an object of the present invention to provide a raker claw hammer which is capable of extracting nails by inertia and/or by leverage. It is an additional object and advantage of the present invention that, insofar as the plane of the claw of the present invention is parallel to the handle thereof, 180° of rotation is obtained when a nail is sought to be removed.

The claw of the present invention is provided with a cutting edge on a portion thereof for chipping, as well as a point for embedding into plywood or planks so that they may be dragged by the carpenter into position thus economizing motion and effort.

An additional advantage of the present invention is that one prong of the claw is provided with a point which may be embedded into a beam or post for carrying purposes. Finally, the claws of the present invention being parallel to the plane of the handle have a relatively narrow profile which facilitates driving nails in confined spaces.

SUMMARY OF THE PRESENT INVENTION

The present invention is an improved hammer having a raker claw, composed of generally a handle, a hammerhead, and such claw. The plane of the claw of the present invention is parallel to the axis of the handle thereof, as opposed to prior art hammers, which have the plane of the their claws curved and typically perpendicular to the hammer handle. The claw of the present invention is composed of two prongs or blades in V-shaped configuration. One of the prongs has a sharpened end for chipping or cutting wood. In addition, the sharpened end of such prong is equipped with a point for embedment in a piece of plywood for dragging, or for embedment in the end of a beam for carrying. Between the prongs or blades is a V-shaped groove, the interior of which has been relieved to facilitate insertion and gripping of a nail head by the craftsman.

IN THE DRAWINGS

FIG. 1 is a plan view of the top of the hammer of the present invention, showing the configuration of the hammerhead and claw.

FIG. 2 is a side elevational view of the present hammer, showing the handle, hammerhead, and claw.

FIG. 3 is an end elevational view of the claw of the present invention, showing the V-shaped groove incised in such claw and the relieved portion thereof.

FIG. 4 shows a nail being extracted from a piece of wood by a hammer constructed according to the present invention showing 180° of rotation.

Now that the present invention has been generally described, its specific parts and operation can be disclosed. Referring particularly to FIG. 1, it will be seen that claw 5, when taken in plan view, narrows to a point 10 at its leading edge. It will further be seen that the portion of hammerhead 20 in which handle 25 has been secured, represented by walls 30 and 35, is quite narrow. Thus, the hammer of the present invention has a thinner profile than does a conventional hammer. Referring to FIG. 2, it will be seen that claw 5 is more particularly composed of blades or prongs 40 and 45. Thus, the hammerhead has a narrower profile than a conventional hammer and can be used in narrow spaces, such as the space common to joicing operations.

Blade or prong 40 has its top edge parallel to the top edge of hammerhead 20. It is also provided with a sharp leading edge 50 which trails away from its upper edge at an obtuse angle. Leading edge 50 meets the bottom of prong or blade 40 at point 10. The bottom of prong or blade 40, designated by the numeral 55, is substantially parallel to the top of blade 40, and forms the upper portion of V-shaped groove 60. Lower blade or prong 45 has an upper edge 65 which meets the lower edge 55 of blade 40 at point 12. It will be seen that the leading edge of lower blade 45 is typically curved. It will further be observed that the intersection of edges 65 and 55 form V-shaped groove 60, which is widely opened at one end and very narrow at point 12. Blades or prongs 40 and 45 are relieved about the periphery of V-shaped groove 60 to accommodate insertion and gripping of a large nail head. Such relieved portion is designated by numeral 70. It will be seen that claw 5, composed of blades 40 and 45 is parallel to the axis of handle 25, typically made of wood.

Referring to FIG. 3, it will be seen that V-shaped groove 60 is rather deep, and has an abnormally wide opening between point 10 of blade 40 and rounded edge 72 of blade 45. Thus, when the hammer of the present invention is swung laterally so that V-shaped groove 60 engages a nail sought to be extracted from a piece of wood, the nail may be extracted by inertia rather than leverage. That is to say, the claw of the present invention need not be particularly placed about the shank of the nail to permit its extraction, but rather, the hammer of the present invention may be swung to engage the nail between its blades and at the same time lift the nail out of the wood.

In addition, it will be observed that since blade 40 is relatively longer than blade 45, leading edge 50 may be used to chip or cut pieces of wood. Further, point 10 may be embedded in a piece of wood and thus a piece of wood can easily be dragged by a workman after the hammer has been swung to embed point 10 in the wood.

In this regard, referencing in particularly FIG. 5, it will be observed that point 10 of the hammer of the present invention may be embedded in the butt or end of a beam. If a second hammer constructed according to the present invention is embedded in the opposite butt or end of a beam, the beam may be carried by a pair of workmen in the manner shown without either workman touching such beam. Referring to FIG. 5, it will be seen that the present invention is constructed so that the claw, when being used to extract a nail from wood, has 180° rather than 90° of rotational ability, thus enabling nails to be extracted with fewer strokes.

Though only one embodiment of the present invention has been shown and described in this specification and drawing, the reasonable range of equivalents within the scope and spirit of the present invention should only be limited by the appended claims.

What is claimed is:

1. An improved claw hammer, comprising a hammerhead, a handle mounted in and normal to said hammerhead, and a pair of claws (claw) provided on said hammerhead, comprising at least two blades having their respective planes parallel to the axis of said handle and defining a V-shaped groove therebetween, one of which claws is pointed and one of which claws is rounded, said pointed claw being longer than said rounded claw (and its claw engages the shank of a nail embedded in wood, the nail will be lifted from the wood by inertia rather than leverage) so that when such hammer is swung laterally so that the shank of a nail comes between each of the claws, such that the rounded portion of one of said claws allows the nail to be driven between said claws, the entire nail will be lifted from the wood by inertia rather than leverage.

* * * * *